US008083070B2

(12) United States Patent
Strasser et al.

(10) Patent No.: US 8,083,070 B2
(45) Date of Patent: Dec. 27, 2011

(54) SCREENING DEVICE FOR SIEVING GRANULAR MATERIAL

(75) Inventors: Siegfried Strasser, Much (DE); Albert Süβegger, Eitorf (DE)

(73) Assignee: KHD Humboldt Wedag GmbH, Cologne (DE)

( * ) Notice: Subject to any disclaimer, the term of this patent is extended or adjusted under 35 U.S.C. 154(b) by 785 days.

(21) Appl. No.: 12/092,668

(22) PCT Filed: Nov. 8, 2006

(86) PCT No.: PCT/EP2006/010670

§ 371 (c)(1),
(2), (4) Date: May 5, 2008

(87) PCT Pub. No.: WO2007/054270

PCT Pub. Date: May 18, 2007

(65) Prior Publication Data

US 2008/0290002 A1 Nov. 27, 2008

(30) Foreign Application Priority Data

Nov. 10, 2005 (DE) ..... 10 2005 053 617

(51) Int. Cl.
*B07B 4/00* (2006.01)

(52) U.S. Cl. ..... 209/142; 209/710

(58) Field of Classification Search ..... 209/142, 209/208, 710–723, 725–729
See application file for complete search history.

(56) References Cited

U.S. PATENT DOCUMENTS

| | | | | |
|---|---|---|---|---|
| 3,155,326 | A * | 11/1964 | Rhodes | 241/53 |
| 3,837,483 | A * | 9/1974 | Noll | 209/30 |
| 3,959,123 | A * | 5/1976 | Wikdahl | 209/728 |
| 4,389,307 | A * | 6/1983 | Boadway | 209/728 |
| 4,784,756 | A * | 11/1988 | Ovaskainen | 209/710 |
| 5,514,271 | A * | 5/1996 | Buchanan et al. | 208/113 |
| 6,183,641 | B1 * | 2/2001 | Conrad et al. | 210/512.3 |
| 6,347,707 | B1 | 2/2002 | Süssegger et al. | |
| 6,457,659 | B1 | 10/2002 | Yang et al. | |
| 6,557,790 | B2 | 5/2003 | Splinter | |
| 6,666,394 | B1 * | 12/2003 | Sussegger et al. | 241/65 |
| 7,503,458 | B2 * | 3/2009 | Kim et al. | 209/711 |

FOREIGN PATENT DOCUMENTS

DE 102 21 739 12/2003

* cited by examiner

*Primary Examiner* — Joseph C Rodriguez
*Assistant Examiner* — Kalyanavenkateshware Kumar
(74) *Attorney, Agent, or Firm* — Greer, Burns & Crain, Ltd.

(57) ABSTRACT

In a screening device for sorting granular material with at least one rotatable rod basket and a downstream fine material separator a cyclone-type eddy separator is attached with the smaller diameter of its housing cone in order to draw off the screening gas flow charged with fine material and flowing out due to twisting energy in such a way that the rod basket screening device and the separator form a compact unit. A submerged pipe is located in the center of the cyclone-type eddy separator for drawing off the screening gas flow freed of fine material. At least one opening is provided for discharging the fine material at the periphery of the eddy separator housing.

16 Claims, 1 Drawing Sheet

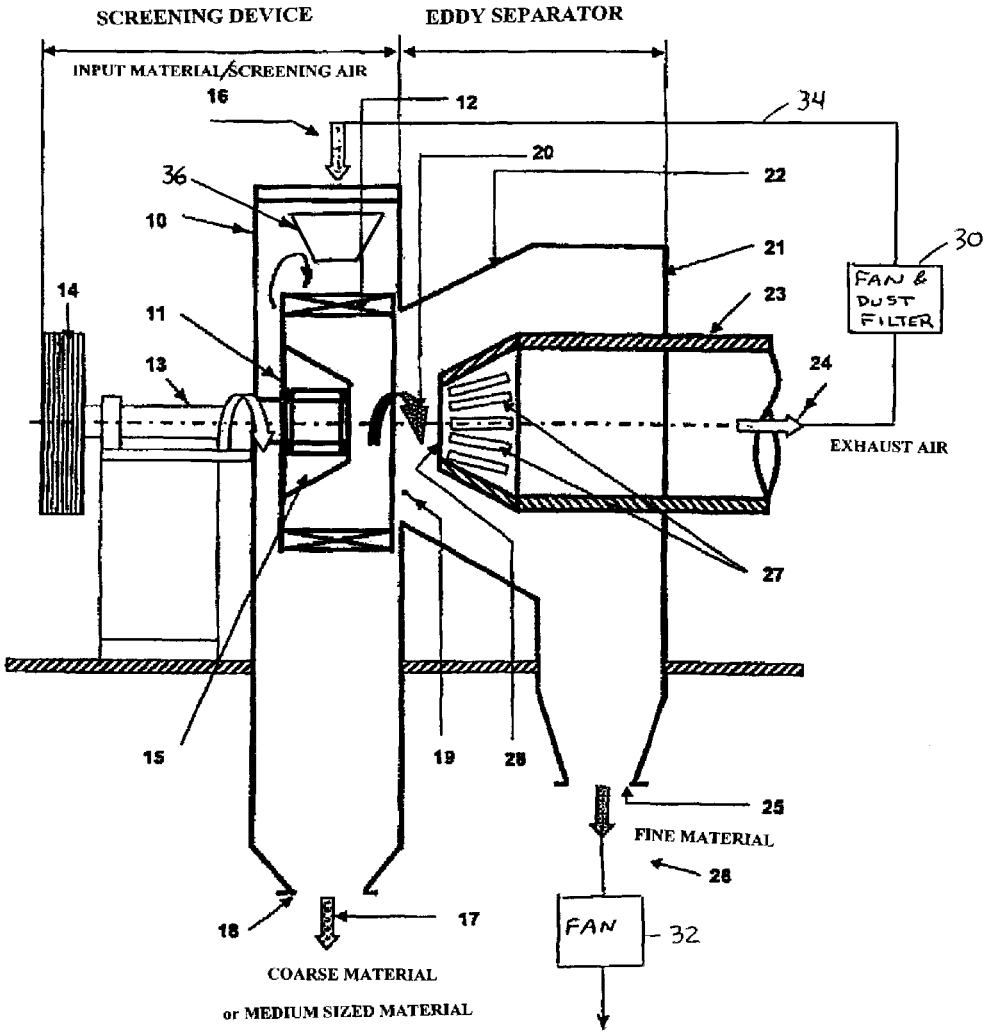
SCREENING DEVICE
EDDY SEPARATOR
INPUT MATERIAL/SCREENING AIR
16
12
34
20
22
36
10
21
30
FAN & DUST FILTER
14
23
11
13
24
EXHAUST AIR
27
15
19
28
25
FINE MATERIAL
26
18
17
FAN
32
COARSE MATERIAL
or MEDIUM SIZED MATERIAL

SCREENING DEVICE FOR SIEVING GRANULAR MATERIAL

BACKGROUND OF THE INVENTION

The invention concerns a screening device for sorting granular materials, with at least one rotatable rod basket located in the screening housing with turbo elements distributed across the circumference of the rotor and with inlets and outlets for screening gas, material to be screened, coarse material and fine material, whereby the outlet opening for the drawing-off of the screening gas flow charged with the fine material is located at least one of the narrow ends of the rotatable rod basket in the screening housing.

Such dynamic screening devices, also known as rod basket screening devices, where the material to be screened is accelerated to the circumferential velocity of the rod basket by the rotating rod basket in the screening zone, and the centrifugal force acting on the particles of the material to be screened and the frictional force of the air stream lead to the material to be screened being divided into coarse material and fine material are already known, e.g., described in "KHD Symposium '92", Volume 1, 1993, by KHD Humboldt Wedag AG, paper by A. Süßegger Screening Report '92 page 63ff, particularly page 65, Fig. 1. The fine material is transported inwards by the air stream against the centrifugal force between the rods of the rod basket and leaves the screening device together with the screening air, whereas the centrifugal force pushes the coarse material to the outer edge of the screening device housing, where it is then transported downwards out of the screening zone by the force of gravity.

In the case of the known dynamic rod basket screening devices, the screening air stream charged with the fine material is routed via a more or less long pipeline to a separator such as a cyclone where the fine material is separated from the screening air. Accordingly, this requires space accordingly. In addition, the connecting pipeline between the rod basket screening device and downstream fine material separator causes a noticeable drop in pressure. This is also applicable even if the connecting pipeline between the rod basket screening device and a downstream cyclone separator is relatively short, as is the case with the known screening equipment DE-A 102 21 739.

SUMMARY OF THE INVENTION

The invention is based on the task of further developing a screening device for sorting granular material with at least one rotatable rod basket and a downstream fine material separator in such a way that both space and specific energy requirements for the complete equipment can be saved.

Thanks to the invention's characteristic of directly connecting a cyclone-type eddy separator with the smaller diameter of its housing cone to the screening device with rotatable rod basket at the screening housing opening for drawing-off the screening gas stream charged with fine material by means of twisting energy and thus making a compact unit out of the rod basket screening device and the downstream fine material separator, without using the usual connecting pipelines, both material and design space for the complete equipment are saved. In addition, this design results in a significant reduction of the specific energy requirements for the complete equipment, mainly due to the removal of the flow resistance otherwise caused by the pipelines and/or the pressure loss for the screening air which otherwise has to be compensated for by additional electrical drive power for the downstream suction blower or for the fan. In addition, there is no longer any loss of acceleration for the screening air and the fine material to be considered, which is otherwise always caused in the inlet by a separating cyclone of conventional design downstream from a rod basket screening device. The saving on specific energy requirements results in particular from the fact that with the screening device of the invention, the twisting energy from the screening gas stream leaving the rod basket charged with fine material is used for the fine material separating process in the directly attached cyclone-type eddy separator, which means the cyclone-type eddy separator does not require a tangential air stream inlet.

Rather, the air stream enters the attached cyclone-type eddy separator of the invention at the spot where with a conventional cyclone separator the cone tip with coarse material discharge is situated. In the center of the cyclone-type eddy separator there is a submerged pipe for drawing off the flow of screening gas after the fine material has been separated off, whereas there is at least an opening for drawing off the fine material separated by the screening air flow at the periphery of the eddy separator housing. In this way, the fine material discharge opening on the cyclone-type eddy separator can be situated at the spot where the inlet for the screening air charged with material to be screened enters a conventional cyclone separator.

According to a further characteristic of the invention, the rotating axis of the rod basket and the central axis of the cyclone-type eddy separator aligned to it can be set up mainly horizontally. These axes can, however, also be set up vertically. If the fine material discharge opening is located in the lowest part of the eddy separator housing, this has the advantage that the fine material can simply be discharged by means of gravity force.

According to a further characteristic of the invention, however, it is also possible for the fine material collected at the periphery of the eddy separator housing and suspended in a screening gas partial flow is drawn off by a separate fan, whereby the submerged pipe of the eddy separator leads to its own fan and dust filter for drawing off the residual screening gas partial flow. The exhaust air at least of the fan connected to the submerged pipe of the eddy separator can be recirculated as ambient air in the screening housing.

The submerged pipe arranged in the eddy separator can have through openings distributed around the circumference of the submerged pipe in the end section facing the rotatable rod basket for the low streaming loss discharge of the screening air. This end section of the submerged pipe can be conically tapered in the direction of the rotatable rod basket, just like the eddy separator housing.

BRIEF DESCRIPTION OF THE DRAWINGS

The invention and its further characteristics and advantages are explained in more detail on the basis of the execution examples represented in the diagrammatic drawing.

The drawing shows a vertical section through a rod basket screening device with a cyclone-type eddy separator directly attached.

DETAILED DESCRIPTION OF THE PREFERRED EMBODIMENTS

In a screening housing (10) there is at least one pivoted rod basket (11) with turbo elements (12) distributed over the circumference of the rotor, to be exact, cantilever to a horizontal shaft (13) which is driven by a motor (14). The rod basket (11) with its turbo elements (12) can have a conical or blunt envelope of cone rather than cylindrical form. There can be a blunt envelope of cone shaped displacer (15) located inside the rod basket (11). The granular material to be screened, which is coming from an air-flow mill, for example, is introduced into the screening housing (10) suspended in a stream of screening air (16). Once in the housing it is accelerated to the circumferential speed of the rotating rod basket (11). The fine material contained in the input material is transported inwards by the air flow against the centrifugal force between the rods (12) of the rod basket (11), and leaves the rod basket together centrally with the screening air on the right hand side in the case of the example illustrated, whereas the coarse material (17) is pushed to the outer edge of the screening housing (10) by the centrifugal force and discharged out of the screening housing (10) through the screening zone and the discharge opening at the bottom (18) by the force of gravity.

The output opening (19) for drawing off the screening gas flow (19) charged with fine material is situated on the right-hand end of the rotating rod basket (11) in the screening housing (11). This gas flow flows out with considerable twisting energy. There is a cyclone-type eddy separator (21) with the smaller diameter of its housing cone (22) attached directly to this screening housing opening (19), so that the rod basket screening device (10, 11) and the separator (21) form a compact unit. In the center of the cyclone-type eddy separator (21) is a submerged pipe (23) for drawing off the screening air flow (24) freed from fine material; the air is drawn in by a suction blower or fan and dust filter (30). At the periphery of the eddy separator housing (21), in the example shown at the bottom edge, there is an opening (25) for discharge of fine material (26) by means of gravity force. It is also possible, however, to draw off the fine material collected at the periphery of the eddy separator housing (21) suspended in a screening gas partial flow by means of a fan (32), which is a different fan than the one that draws off the screening air flow (24).

It goes without saying that the exhaust air (24) of at least the fan connected to the submerged pipe (23) of the eddy separator (21) can be recirculated through conduit (34) as ambient air in the screening housing.

As the drawing also shows, the submerged pipe (23) located in the eddy separator (21) can have window- or slot-type through openings (27) distributed around the circumference of the submerged pipe section facing the rotatable rod basket (11) to allow the screening air (24) to escape. In addition, the drawing shows that the end section of the cylindrical submerged pipe (23) facing the rotatable rod basket can be tapered conically, whereby the submerged pipe (23) can be closed at one end (28) so that the twisting stream (20) of the screening air is forced to flow through the window-type openings (27) into the submerged pipe (23).

In the screening housing (10) a static cascade screening device (36) can at least be included on the screening air flow side of the rotatable rod basket (11), so that discharge for coarse material is located near the cascade screening device in the screening housing, discharge (18) for the medium-sized material (17) is near the rod basket screening section (11) and the fine material (26) is discharged through the eddy separator housing (21). Such a static cascade screening device (36) has two screening zone limiting walls surrounded by the screening housing, forming a screening zone between and flowed through by the screening air or hot gas as drying gas being blown crosswise, for example. These walls have cascade-type or Venetian blind type baffles arranged slanted downwards, whereby these two baffle walls and the screening zone between them are arranged at an angle to the vertical. Such a static cascade screening device (36) is extremely suitable for splitting up or disagglomerating agglomerated material such as pressed scabbing from a material bed size reduction roller press or high-pressure roller mill.

In the screening housing (10) a non-rotating, stationary vane ring can be positioned around the rotating rod basket (11).

In accordance with the invention, several cyclone-type eddy separators of the same design type can be arranged around the circumference of the screening housing opening (19), through which the screening gas flow (20) charged with fine material and twisting force is discharged, whereby the tangential component of the screening gas flow (20) in the connection between the screening housing (10) and the input in the several eddy separators (21) remains.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A screening device for sorting granular material with at least one rod basket having a rotor rotatable about an axis and located in a screening housing with turbo elements distributed across a circumference of the rotor, the screening housing having inlets and outlets for screening gas, material to be screened, coarse material and fine material, whereby the outlet for a drawing-off of the screening gas flow charged with the fine material is an opening located at least one axial end of the rod basket in the screening housing comprising:

a. at the screening housing opening for drawing off the screening gas flow charged with fine material, a cyclone-type eddy separator is attached, the cyclone-type eddy separator having a housing cone aligned with the axis of the rotor and having a smaller diameter of the cone attached to the screening housing opening and a larger diameter of the cone spaced away from the screening housing opening in a direction of the screening gas flow, so that the rod basket screening device and the separator form a compact unit, b. in a center of the cyclone-type eddy separator there is a submerged pipe for drawing off the screening gas flow freed from the fine material, and c. at a periphery of the eddy separator housing there is at least one opening for discharging the fine material.

2. A screening device according to claim 1, wherein the rotating axis of the rod basket and a central axis of the cyclone-type eddy separator are aligned and are arranged substantially horizontally.

3. A screening device according to claim 1, wherein the discharge opening for the fine material is situated in a lowest section of the eddy separator housing and the fine material is discharged by means of gravitational force.

4. A screening device according to claim 1, wherein the fine material collected at a periphery of the eddy separator housing and suspended in a screening gas partial flow is drawn off by a separate fan, whereby the submerged pipe of the eddy separator leads to its own fan and dust filter for drawing off a residual screening gas partial flow.

5. A screening device according to claim 4, wherein the exhaust gas at least of the fan connected to the submerged pipe of the eddy separator is recirculated as ambient gas in the screening housing.

6. A screening device according to claim 1, wherein the submerged pipe arranged in the eddy separator has through openings distributed around a circumference of the submerged pipe in an end section facing the rotatable rod basket.

7. A screening device according to claim 1, wherein the submerged pipe in the eddy separator facing the rotatable rod basket is tapered conically.

8. A screening device according to claim 1, including a static cascade screening device at least being included on a screening air flow side in the screening housing, so that discharge is near the cascade screening device in the screening housing for coarse material, near the rod basket screening section for medium-sized material and near the eddy separator housing for fine material.

9. A screening device for sorting granular material comprising:

at least one rotatable rod basket located in a screening housing and comprising a rotor rotatable about an axis, the rod basket having turbo elements distributed around a circumference of the rotor, the screening housing having inlets and outlets for screening gas, an inlet for material to be screened, an outlet for coarse material and an outlet for fine material, the outlet for the screening gas comprising the outlet for the fine material and being located at the axis of the rotor of the rod basket in the screening housing, a cyclone-type eddy separator having a housing cone aligned with the axis of the rotor and having a smaller diameter of the cone attached to the screening housing screening gas and fine material outlet and a larger diameter of the cone spaced away from the screening housing screening gas and fine material outlet in a direction of the screening gas flow, so that the rod basket screening housing and the eddy separator form a compact unit, a submerged pipe being located along a center axis of the cyclone-type eddy separator to draw off screening gas flow freed from the fine material, and at least one opening for discharging the fine material located at a periphery of the eddy separator housing.

10. A screening device according to claim 9, wherein the axis of the rod basket and the center axis of the cyclone-type eddy separator are aligned and are arranged horizontally.

11. A screening device according to claim 9, wherein the discharge opening for the fine material is positioned in a lowest section of the eddy separator housing so that the fine material is discharged by gravitational force.

12. A screening device according to claim 9, wherein a first fan and a dust filter are connected to the submerged pipe to draw off a first portion of the screening gas and a second, separate fan is connected to the discharge opening for the fine material to draw off the fine material and a second portion of the screening gas.

13. A screening device according to claim 12, wherein exhaust gas, at least from the first fan, being recirculated as screening gas in the screening housing.

14. A screening device according to claim 9, wherein the submerged pipe has a plurality of through openings distributed around a circumference of the submerged pipe in an end section facing the rotatable rod basket.

15. A screening device according to claim 9, wherein the submerged pipe facing the rotatable rod basket is conically tapered.

16. A screening device according to claim 9, including a static cascade screening device being positioned in the screening housing between the screening gas inlet and the rotor, so that discharge from the static cascade screening device is near the cascade screening device in the screening housing for coarse material, near the rod basket screening section for medium-sized material and near the eddy separator housing for fine material.

* * * * *